US005954076A

United States Patent [19]

McGinnis

[11] Patent Number: 5,954,076

[45] Date of Patent: Sep. 21, 1999

[54] TENT STRUCTURE FOR TRUCK BEDS

[76] Inventor: Graham McGinnis, 1616 W. Curry, Chandler, Ariz. 85224

[21] Appl. No.: 09/002,663

[22] Filed: Jan. 5, 1998

Related U.S. Application Data

[60] Provisional application No. 60/035,792, Jan. 9, 1997.

[51] Int. Cl.[6] ..... E04H 15/06

[52] U.S. Cl. ..... 135/88.13; 135/88.06; 135/88.09; 135/88.14; 135/88.15; 296/159; 296/161; 296/165

[58] Field of Search ..... 296/100.01, 159, 296/160, 163, 167, 173, 165, 164; 135/88.13, 88.14, 88.15, 88.16, 91, 88.05, 88.06, 88.09

[56] References Cited

U.S. PATENT DOCUMENTS

| | | | |
|---|---|---|---|
| Re. 29,264 | 6/1977 | Woodward | 135/88.14 |
| 3,367,347 | 2/1968 | Smith | 135/1 |
| 4,332,265 | 6/1982 | Baker | 135/3 A |
| 4,652,040 | 3/1987 | Mahan | 296/159 |
| 4,657,299 | 4/1987 | Mahan | 296/159 |
| 5,299,849 | 4/1994 | Cook et al. | 296/100 |
| 5,419,607 | 5/1995 | Oliveira | 296/159 |
| 5,758,679 | 6/1998 | Tamburelli | 135/88.09 |

*Primary Examiner*—Beth Aubrey
*Attorney, Agent, or Firm*—Joseph N. Breaux

[57] ABSTRACT

A tent structure for truck beds including a collapsible pole structure constructed from a plurality of interlockable tent poles; and a tent cover member positionable in connection with and supported by the collapsible pole structure, the cover member having a pair of wheel well receiving cavities for receiving the wheel well structures of a pickup truck when the tent structure is erected on a bed of a pickup truck and at least two pickup truck sidewall cover flaps, each sidewall cover flap having at least two flexible securing straps securable between side a side edge of the sidewall cover flap and the pickup truck. In a preferred embodiment, the tent structure further includes a lighting system including a light bulb assembly, an electrical distribution wiring harness, and an electrical system connector. The electrical distribution wiring harness is connected between the system connector and the light bulb assembly. The system connector is preferably connectable to the cigarette lighter socket of the truck.

6 Claims, 2 Drawing Sheets

TENT STRUCTURE FOR TRUCK BEDS

This application claims the benefits under 35 U.S.C. 119(e) of earlier filed provisional application No. 60/035,792, filed Jan. 9, 1997.

TECHNICAL FIELD

The present invention relates to tent structures and more particularly to a collapsible tent structure having sidewalls adapted to provide a wheel well structure receiving cavity in each tent sidewall that can be erected on the bed of a pickup truck.

BACKGROUND OF INVENTION

It is often desirable when hiking, hunting or fishing to have a tent that can be erected to provide shelter at night and taken down for transporting to a new location during the day. Although there are numerous collapsible tent structures that are adapted to be erected on the earth surface, few collapsible tents are adapted for erection onto the bed of a pickup truck. Using the bed of a pickup truck can provide many advantages to a camper such as height above the ground, and the rigid sidewalls of the pickup truck provide added security. It would be a benefit, therefore, to have a collapsible tent structure that could be erected onto the bed of a pickup truck. Because most pickup truck beds have a pair of wheel well structures projecting upwardly therefrom, it would be a further benefit, to have a collapsible tent structure that included wheel well receiving cavities for receiving the wheel well structures when the collapsible tent structure is fully erected.

SUMMARY OF INVENTION

It is thus an object of the invention to provide a tent structure for truck beds that can be erected onto the bed of a pickup truck.

It is a further object of the invention to provide a tent structure for truck beds that can be erected onto the bed of a pickup truck and that includes wheel well receiving cavities for receiving the wheel well structures when the collapsible tent structure is fully erected.

It is a still further object of the invention to provide a tent structure for truck beds that accomplishes both of the above objects in combination.

Accordingly, a tent structure for truck beds is provided. The tent structure comprises a collapsible pole structure constructed from a plurality of interlockable tent poles; and a tent cover member positionable in connection with and supported by the collapsible pole structure, the cover member having a pair of wheel well receiving cavities for receiving the wheel well structures of a pickup truck when the tent structure is erected on a bed of a pickup truck and at least two pickup truck sidewall cover flaps, each sidewall cover flap having at least two flexible securing straps securable between side edge of the sidewall cover flap and the pickup truck. In a preferred embodiment, the tent structure further includes a lighting system including a light bulb assembly, an electrical distribution wiring harness, and an electrical system connector. The electrical distribution wiring harness is connected between the system connector and the light bulb assembly. The system connector is preferably connectable to the cigarette lighter socket of the truck.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
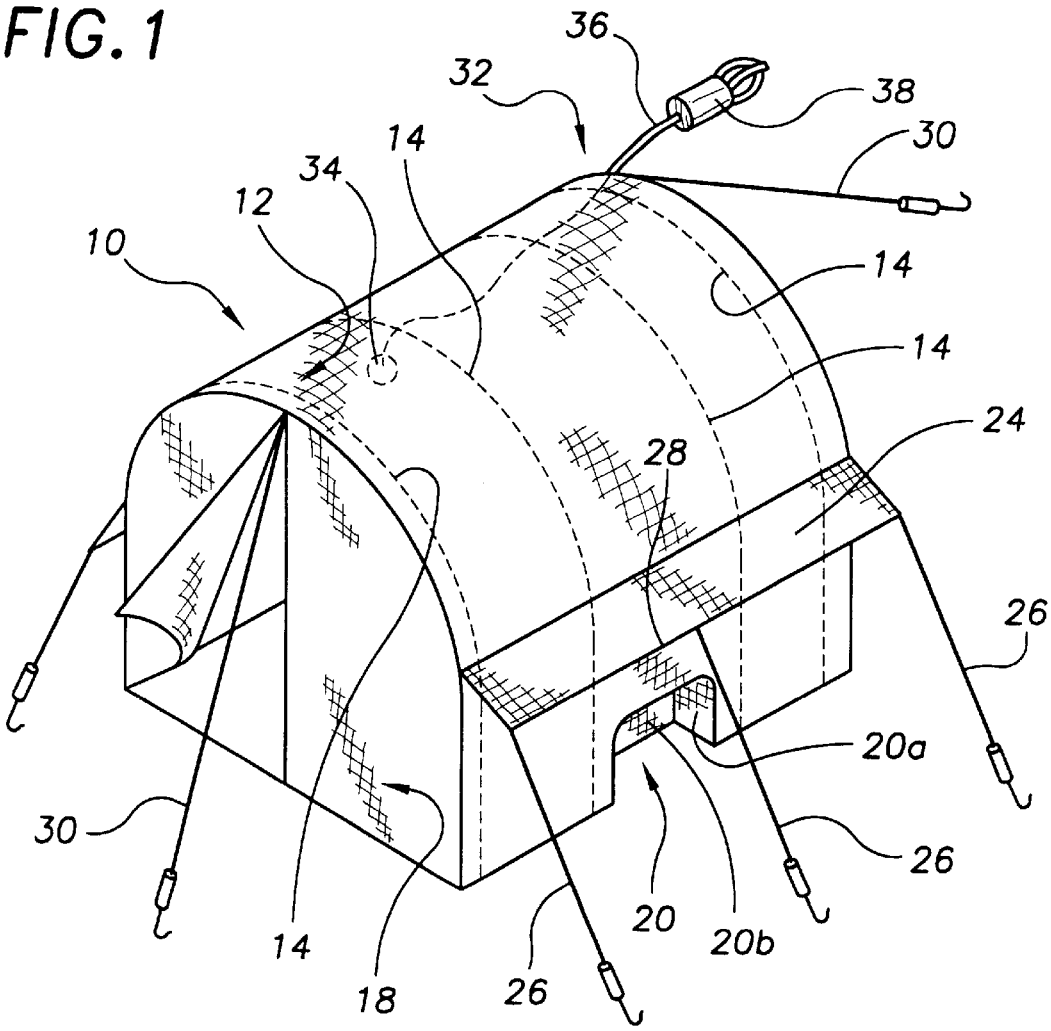
FIG. 1 is perspective view of an exemplary embodiment of the tent structure for truck beds of the present invention showing the collapsible pole structure, and the tent cover member including the pair of wheel well receiving cavities, the two pickup truck sidewall cover flaps, the flexible securing straps, and the lighting system including the light bulb assembly, the electrical distribution wiring harness, and the electrical system connector.

FIG. 1 shows a first exemplary embodiment of the tent structure for truck beds of the present invention generally designated by the numeral 10. Tent structure 10 includes a collapsible pole structure, generally designated by the numeral 12, formed from a plurality of interlockable, fiberglass, tent poles 14; and a waterproof fabric tent cover member, generally designated by the numeral 18, that is positionable over and supported by collapsible pole structure 12. Cover member 18 has a two wheel well receiving cavities 20 (only one shown) sized and positioned such that when tent structure 10 is erected onto a bed of a pickup truck, the wheel well structures of the pickup truck are positioned within the wheel well receiving cavities 20. Each wheel well receiving cavity is open on two sides thereof and defined by two tent panels 20*a*,20*b* that are stitched or otherwise attached to form a wheel well cavity 20 that is shaped to receive a wheel well structure without deformation of tent panels 20*a*,20*b*. Cover member 18 also includes two pickup truck sidewall cover flaps 24 (only one show) that extend from the sides of cover member 18 at a location above each of the wheel well receiving cavities 20. Each sidewall cover flap 24 includes three flexible, elastic, securing straps 26 that are each securable between a side edge 28 of each sidewall cover flap 24 and the pickup truck. Two elastic, flexible cover member securing straps 30 are also provided for securing cover member 18 in place. In this embodiment, tent structure 10 also includes a lighting system, generally designated by the numeral 32, that includes a light bulb assembly 34, an electrical distribution wiring harness 36, and an electrical system connector 38. Light bulb assembly includes a light bulb and a light bulb socket. Wiring harness 36 is a length of two conductor electrical wire. System connector 38 is a conventional cigarette lighter socket connector.

Figure 2:
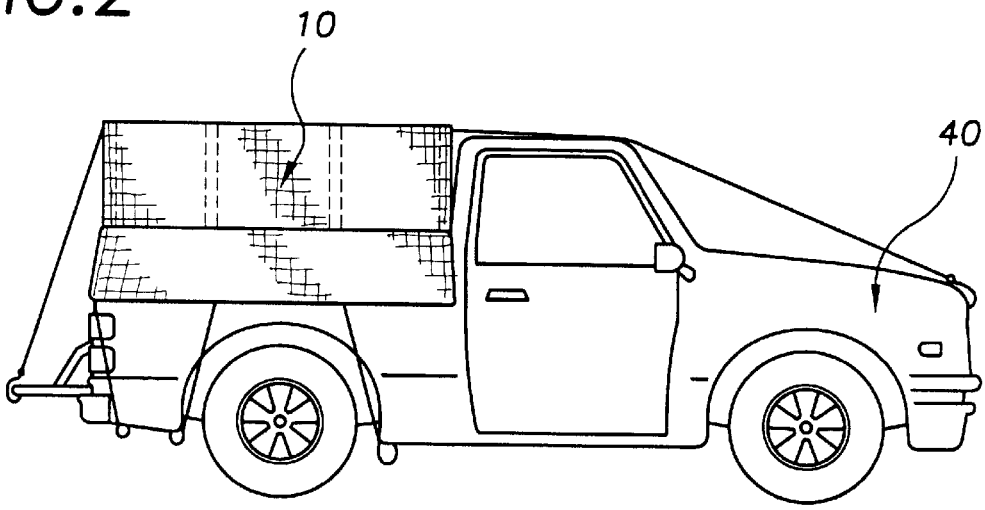
FIG. 2 is a side plan view of the exemplary tent structure for truck beds of FIG. 1 installed onto the truck bed of a representative pickup truck.
Figure 3:
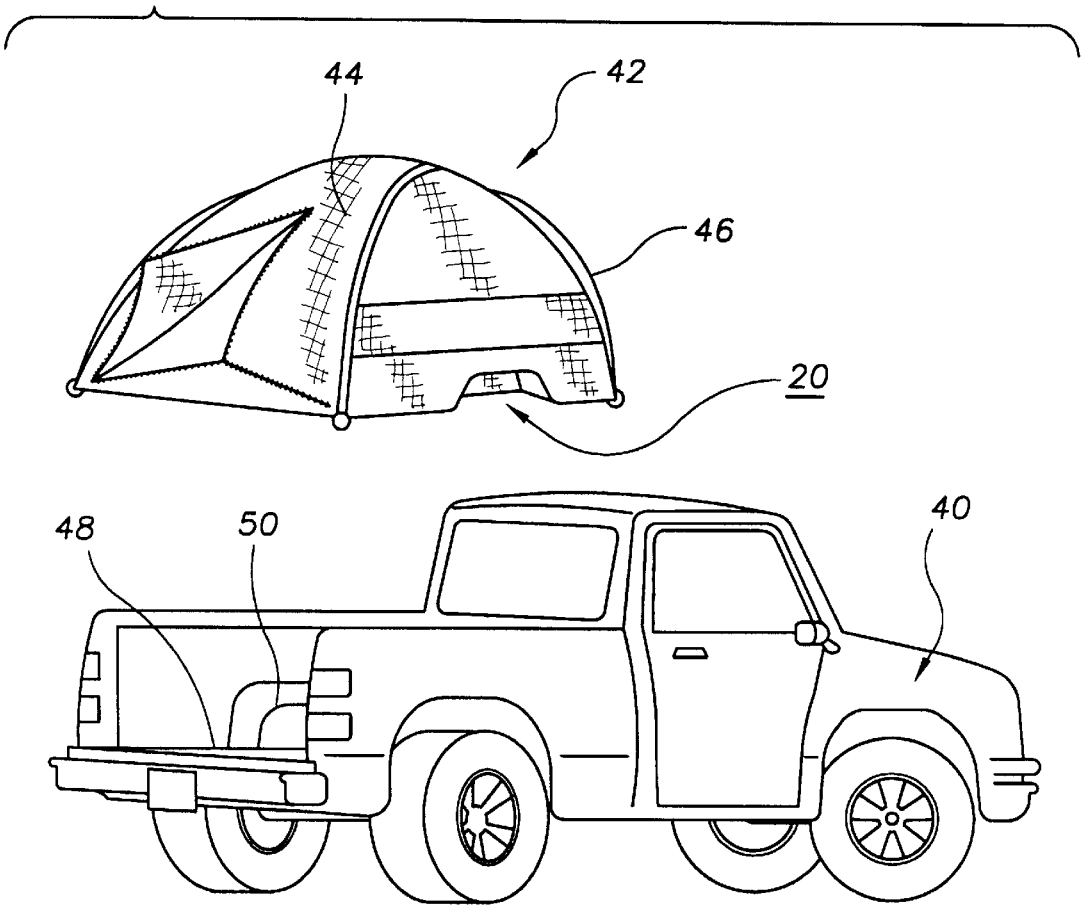
FIG. 3 is a perspective view of a second exemplary tent structure for truck beds showing a dome shaped cover member and an exteriorly positioned collapsible pole structure showing the bed of a representative pickup truck including one of the two wheel well structures.

FIG. 2 shows tent structure 10 installed onto the truck bed of a representative pickup truck generally designated by the numeral 40. FIG. 3 shows a second exemplary tent structure, generally designated by the numeral 42. In this embodiment, tent structure 42 includes a dome shaped, fabric cover member 44 and an exteriorly positioned collapsible pole structure 46. Also shown in the figure is a section of the truck bed 48 and one of the two wheel well structures 50 that fit within the wheel well structure receiving cavities 20.

It can be seen from the preceding description that a tent structure for truck beds has been provided that can be erected onto the bed of a pickup truck and that includes wheel well receiving cavities for receiving the wheel well structures when the collapsible tent structure is fully erected.

It is noted that the embodiment of the tent structure for truck beds described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A tent structure for truck beds comprising:

a collapsible pole structure constructed from a plurality of interlockable tent poles; and a tent cover member positionable in connection with and supported by said collapsible pole structure, said cover member having a pair of wheel well receiving cavities for receiving wheel well structures of a pickup truck when said tent structure is erected on a bed of a pickup truck and at least two pickup truck sidewall cover flaps, each sidewall cover flap having at least two flexible securing straps securable between side edges of said sidewall cover flap and a pickup truck.

2. The tent structure for truck beds of claim 1, wherein:

said tent structure further includes a lighting system including a light bulb assembly, an electrical distribution wiring harness, and an electrical system connector, said electrical distribution wiring harness being connectable between said system connector and said light bulb assembly.

3. The tent structure for truck beds of claim 2, wherein:

said system connector includes a plug that is connectable to a cigarette lighter socket of a truck.

4. The tent structure for truck beds of claim 1 wherein:

each of said pickup truck sidewall cover flaps extends from sides of said cover member at a location above one of said wheel well receiving cavities.

5. The tent structure for truck beds of claim 2 wherein:

each of said pickup truck sidewall cover flaps extends from sides of said cover member at a location above one of said wheel well receiving cavities.

6. The tent structure for truck beds of claim 3 wherein:

each of said pickup truck sidewall cover flaps extends from sides of said cover member at a location above one of said wheel well receiving cavities.

* * * * *